United States Patent [19]

Ichimura et al.

[11] Patent Number: 4,624,525

[45] Date of Patent: Nov. 25, 1986

[54] COAXIAL CABLE CONNECTOR

[75] Inventors: Yoshiaki Ichimura; Natsuki Kawabe; Haruo Hayashi; Kouzou Uekido, all of Tokyo, Japan

[73] Assignees: Japan Aviation Electronics Industry Limited; NEC Corporation, both of Tokyo, Japan

[21] Appl. No.: 743,837

[22] Filed: Jun. 12, 1985

[30] Foreign Application Priority Data

Jun. 22, 1984 [JP] Japan ..... 59-93657

[51] Int. Cl.[4] ..... H01R 17/18

[52] U.S. Cl. ..... 339/177 R; 339/276 R; 339/208

[58] Field of Search ..... 339/177, 143 R, 210 R, 339/210 M, 208, 192 M, 104, 207

[56] References Cited

U.S. PATENT DOCUMENTS 3,290,461 12/1966 Schumacher ..... 339/177 R
3,471,825 10/1969 Huber ..... 339/177 R
4,129,352 12/1978 Izuka ..... 339/177 R
4,416,501 11/1983 Fusselman et al. ..... 339/177 R
4,477,132 10/1984 Moser et al. ..... 339/177 R

*Primary Examiner*—Gil Weidenfeld
*Assistant Examiner*—David L. Pirlot
*Attorney, Agent, or Firm*—Pollock, Vande Sande and Priddy

[57] ABSTRACT

A connector for connection of a coaxial cable comprises a cylindrical holder composed of a support member and a lid member of semi-cylindrical configurations made of insulator material, and a center contact stored and held in the front end portion of the cylindrical holder. One end of the coaxial cable is held in a cable holding section in the rear of the center contact, a core wire of the coaxial cable is connected to the center contact, a ferrule is disposed in an opening formed at the cable holding section, an exposed outer conductor portion of the coaxial cable is folded and disposed on the ferrule and connected electrically thereto, the cylindrical holder is fitted and inserted in a metallic cylindrical body, and the ferrule is elastically deformed thereby to electrically connect the cylindrical body and the outer conductor together.

20 Claims, 17 Drawing Figures

COAXIAL CABLE CONNECTOR

BACKGROUND OF THE INVENTION

1. Field of the Invention

This invention relates to a coaxial cable connector used for connection of a coaxial cable with a contact unit mounted on a circuit board, for example.

2. Description of the Prior Art

FIGS. 1A through 1C illustrate the connection process of a coaxial cable with a coaxial cable connector widely used hitherto in this field. Referring to these drawings, a nut 10 is slipped onto a coaxial cable 11, and a sheath 12 is removed at the end portion of the coaxial cable 11 so as to expose an outer conductor 13, as shown in FIG. 1A. An inner insulator 15 inside the end portion of the exposed outer conductor 13 is removed, an end portion 13*a* of the outer conductor 13 is made narrower, and a washer 14*a*, gasket 14*b* and clamp 14*c* are then slipped in this order onto the sheath 12. At this state, a collar of the clamp 14*c* is caused to abut on the end face of the sheath 12. As shown in FIG. 1B, the outer conductor 13 is then cut to a given length, its netted wires are unraveled, the thus unraveled portion is folded down and disposed on the outer surface of the clamp 14*c* as indicated by 13*b*. The exposed inner insulator 15 is then cut to a given length to expose a core wire 16, and this core wire 16 is also cut to a given length. The core wire 16 is inserted into a hole of a female contact 17, soldered and secured in place, as shown in FIG. 1C. At this stage, the coaxial cable 11 is inserted and fitted in a jack body 21, and secured by turning the nut 10 with respect to the jack body, as shown in FIG. 2.

On the other hand, when it is desired to form a plug type connector, a male contact 23 (see FIG. 3), in place of the female contact 17, is secured to the core wire 16 of the coaxial cable semi-finished as shown in FIG. 1B. At this stage, the coaxial cable is inserted into a plug body 22 and secured in place by turning the nut 10 with respect to the plug body 22, as shown in FIG. 3.

As is apparent from the foregoing, the conventional coaxial cable connector needs a number of parts or segments, its structure is complicated, it can hardly be miniaturized and is not suited for a machining work. Further, there are several parts which must be attached previously to the coaxial cable at the time of connection; thus, if any parts were left unattached the assembling process must be started over again. Furthermore, before attaching the plug body or jack body to the coaxial cable the exposed length of the inner insulator 15 and/or core wire 16 must be defined precisely; if not, the contacts 17, 23 cannot be positioned at a given location inside the bodies 21, 22 in directions along the axial center. Accordingly, the connection was not easily made in case of the conventional coaxial cable connector.

SUMMARY OF THE INVENTION

It is the object of the present invention to overcome the foregoing disadvantages of the conventional connector, and to provide a coaxial cable connector which is simple in overall structure, needs few parts, is miniaturizable, permits a relatively large degree of tolerance for the coaxial cable processed, and can easily be attached and connected to the coaxial cable.

According to the present invention, a cylindrical holder is composed of a support member and a lid member of semi-cylindrical configuration and made of insulator material, inside the front end portion of the cylindrical holder a contact holding section is formed, and in this contact holding section a center contact is stored and held in place. This center contact is designed so that as a mating contact is inserted from the front end into the cylindrical holder the two come into contact with one another. The inside of the rear end portion of the cylindrical holder functions as a cable holding section, so that one end of a coaxial cable is stored and held inside the cylindrical holder in a further rear of the center contact and the other end is led outward from the rear end of the cylindrical holder.

A core wire of the coaxial cable is exposed at the inserted end and this core wire is electrically connected to the center contact. The cylindrical holder is formed in the cable holding section with an opening, in this opening a ferrule made of elastic material is disposed, on the outer face of this ferrule a folded outer conductor portion of the coaxial cable is disposed, the thus processed cylindrical holder is fitted and inserted into a cylindrical metallic body, and the ferrule is elastically deformed, whereby the folded outer conductor and cylindrical body are electrically connected together.

As will be apparent from the foregoing, according to the present invention, the center contact, coaxial cable and ferrule can be stored inside the support member with the lid member opened and connected to one another through a simple assembling operation. The support member and lid member are coupled together by a bendable portion; thus, these members can be fabricated as a single molded body. The ferrule can be produced by pressing. Accordingly, all parts can be produced through a simple process, and the number of parts can be reduced. By positioning and holding the center contact in the contact holding section inside the cylindrical holder the position in the axial direction of the center contact is determined correctly, and a large dimensional tolerance is allowed in processing the coaxial cable.

DESCRIPTION OF THE PREFERRED EMBODIMENTS

The coaxial cable connector according to the present invention will now be described with reference to the drawings showing its embodiments.

Figure 1A:
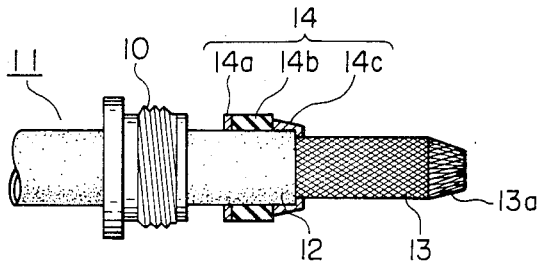
FIG. 1A PRIOR ART
FIGS. 1A through 1C are side views showing the connection process of the conventional coaxial cable connector relating mainly to a coaxial cable.
Figure 1B:
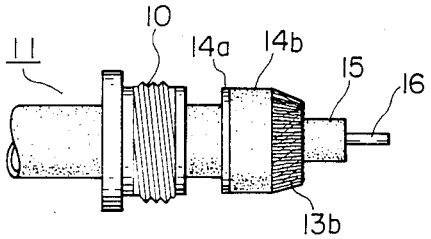
FIG. 1B PRIOR ART
Figure 1C:
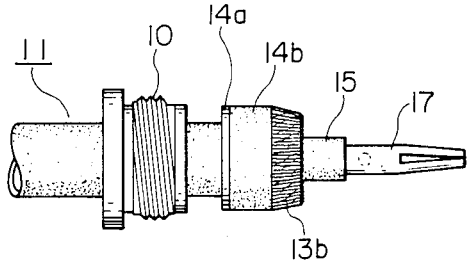
FIG. 1C PRIOR ART
Figure 2:
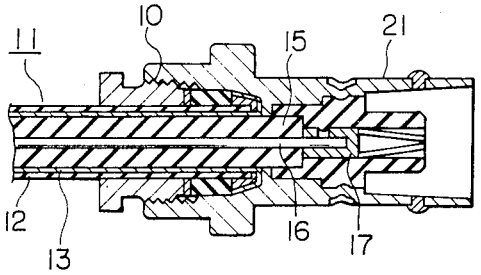
FIG. 2 PRIOR ART
FIG. 2 is a cross sectional view showing the conventional jack for the coaxial cable.
Figures 3, 4:
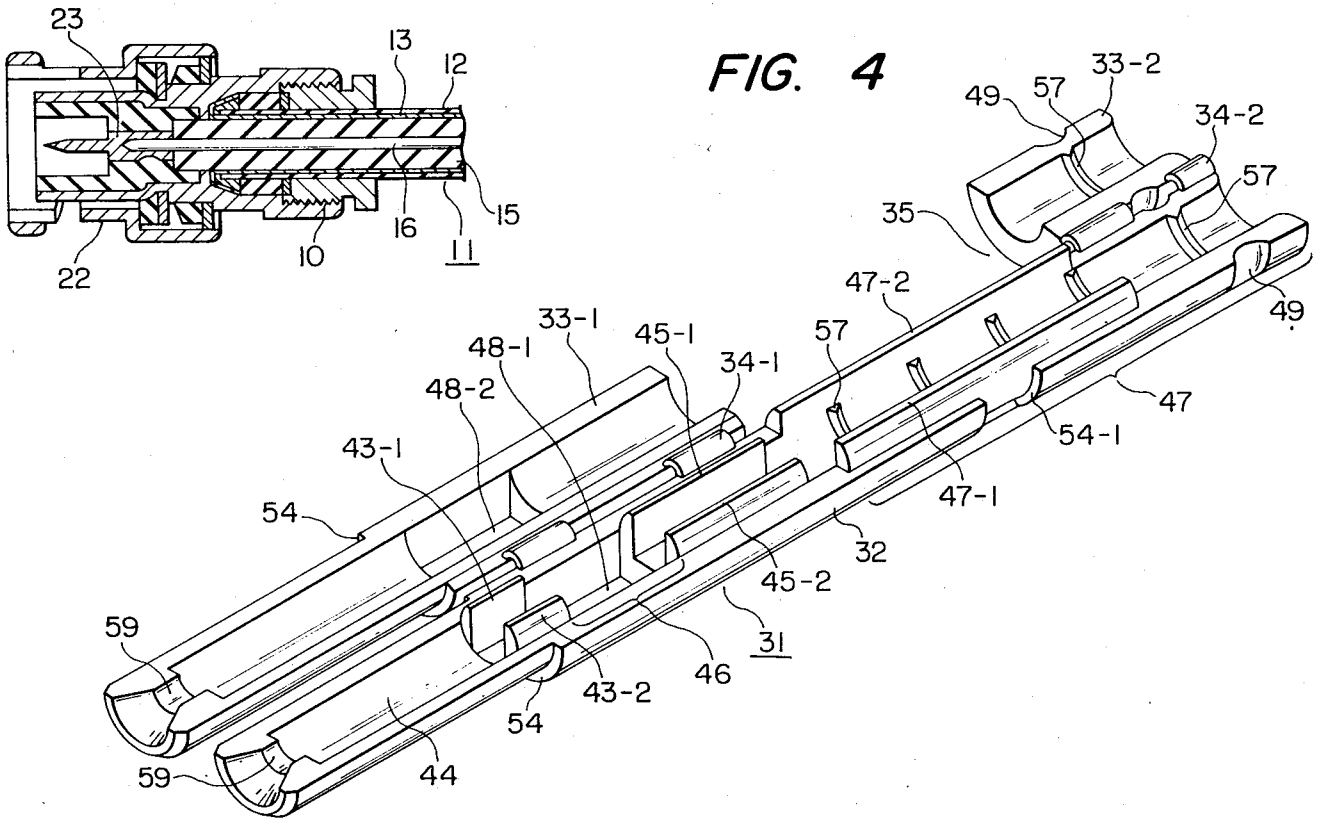
FIG. 3 PRIOR ART
FIG. 3 is a cross sectional view showing the conventional plug for the coaxial cable.
FIG. 4 is a perspective view showing a cylindrical holder 31 in an open state of an embodiment of a coaxial cable connector according to the present invention.

FIG. 4 is a perspective view showing in the open state the structure of a cylindrical holder 31 of an embodiment of the coaxial cable connector according to the present invention. The holder 31 is made of an insulating material, such as synthetic resin, and has a substantially cylindrical shape. The cylindrical holder 31 is divided along the axial direction into two substantially semi-cylindrical parts; thus, it is composed of a support member 32 which is substantially semi-cylindrical over the whole length of the connector, and lid members 33-1 and 33-2 which are attached pivotably to, and adapted to cover, the support member 32.

In the embodiment the lid members 33-1 and 33-2 are coupled pivotably to the side margin of the support member 32 by respective hinge portions 34-1 and 34-2. The support member 32, lid members 33-1 and 33-2, and hinge portions 34-1 and 34-2 are made by synthetic resin in the form of a single molded body. The lid members 33-1 and 33-2 are positioned with respect to the support member 32 so as to leave a space therebetween in the center portion of the support member. Accordingly, in the covered state of the support member 32 resulting from pivoting of the lid members 33-1 and 33-2 toward the support member 32, there is formed an opening 35 between these lid members 33-1 and 33-2 in the center portion in the axial direction of the cylindrical holder 31.

One end of the coaxial cable is loaded and held inside the cylindrical holder 31, and the other end is led outward from the rear end of the cylindrical holder 31. Inside the front end portion of the cylindrical holder 31 a center contact 38 (FIG. 6) is stored and held in place.

Figure 5:
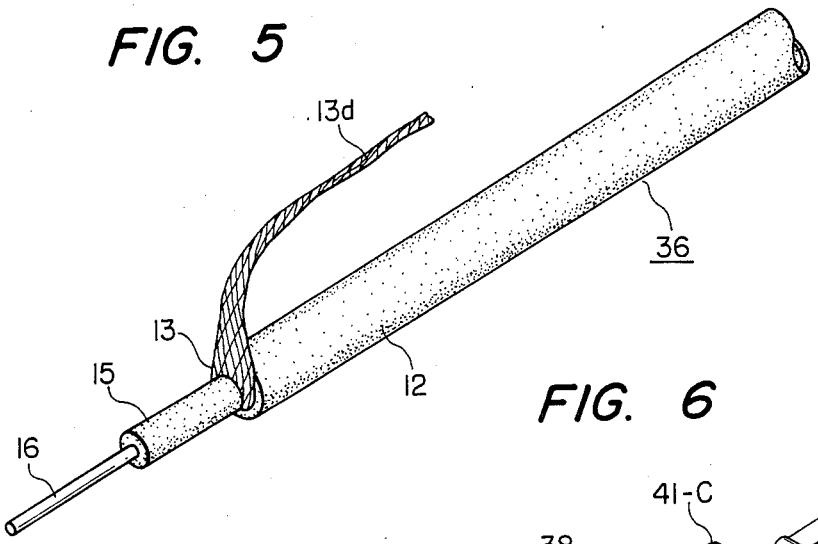
FIG. 5 is a perspective view showing a coaxial cable which is processed for attachment to the above embodiment.

As shown in FIG. 5, a sheath 12 of the coaxial cable 36 is cut off at the connection end so as to expose an outer conductor 13, and the thus exposed outer conductor 13 is twisted into a braid shape and led out sideways, this being treated as an outer conductor connection segment 13d. A portion of inner insulator 15 from which the outer conductor 13 is taken away is then removed so as to expose a core wire 16 at the end of the coaxial cable 36.

Figure 6:
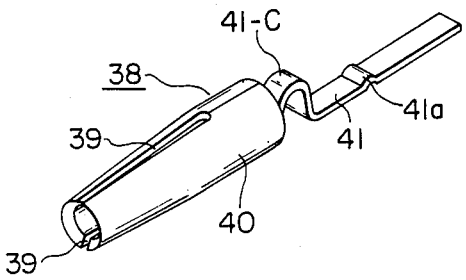
FIG. 6 is a perspective view showing a center contact 38 of the above embodiment.
Figure 8:
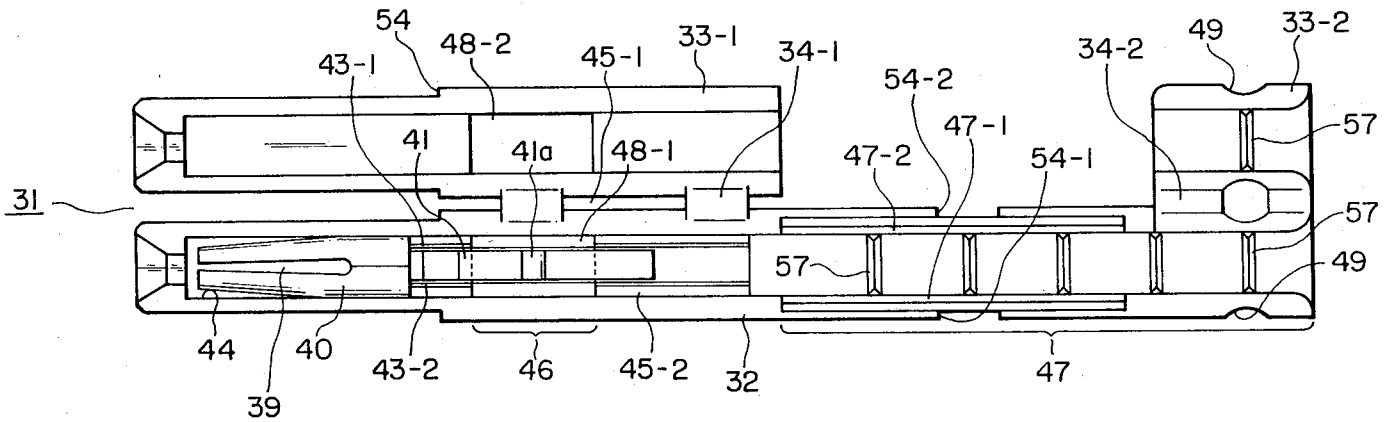
FIG. 8 is a plan view showing the state wherein the center contact is stored in the opened cylindrical holder 31.
Figure 9:
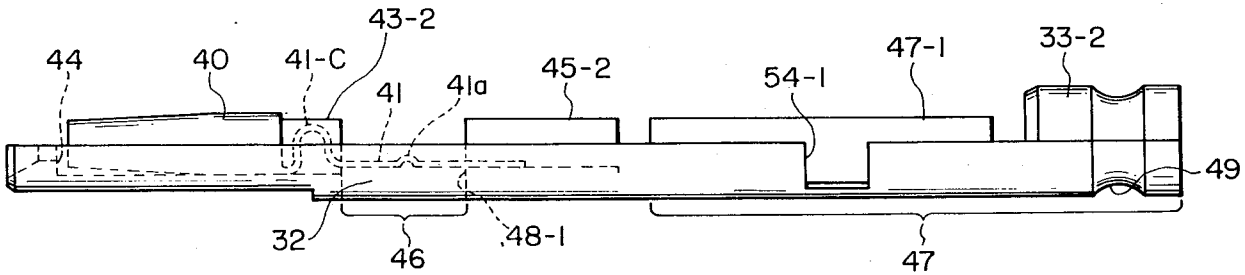
FIG. 9 is a front view corresponding to FIG. 8, in which a lid member 33-2 is closed.

As shown in FIG. 6, the center contact 38 comprises an elastic clamp member 40 which, in the case of a female contact, is made substantially cylindrical and has formed therein notches 39 extending in its lengthwise direction, these notches 39 being made narrower toward the front end of the contact so that the front contact portions are closer to each other and biased elastically in directions orthogonal to the axial center. From the rear end of this cylindrical elastic clamp member 40 an integral connection segment 41 is led out rearward. In a mid-portion of the connection segment 41 a connection portion 41*a* is formed projecting widthwise. As shown in FIGS. 8 and 9, this center contact 38 is stored and held in a contact holding section 44 inside the front end portion of the cylindrical holder 31. On the sides of the rear end of the contact holding section 44 positioning segments 43-1 and 43-2 are formed on the support member 32 in opposition to each other, and between these positioning segments 43-1 and 43-2 is disposed a bent portion 41-C on the side of the elastic clamp member 40 of the connection segment 41. At this stage, the rear end face of the elastic clamp member 40 abuts on the front end of the positioning segments 43-1 and 43-2, whereby the center contact 38 is positioned correctly. The rear end portion of the elastic clamp member 40 is fitted roughly into the contact holding section 44.

Figure 10:
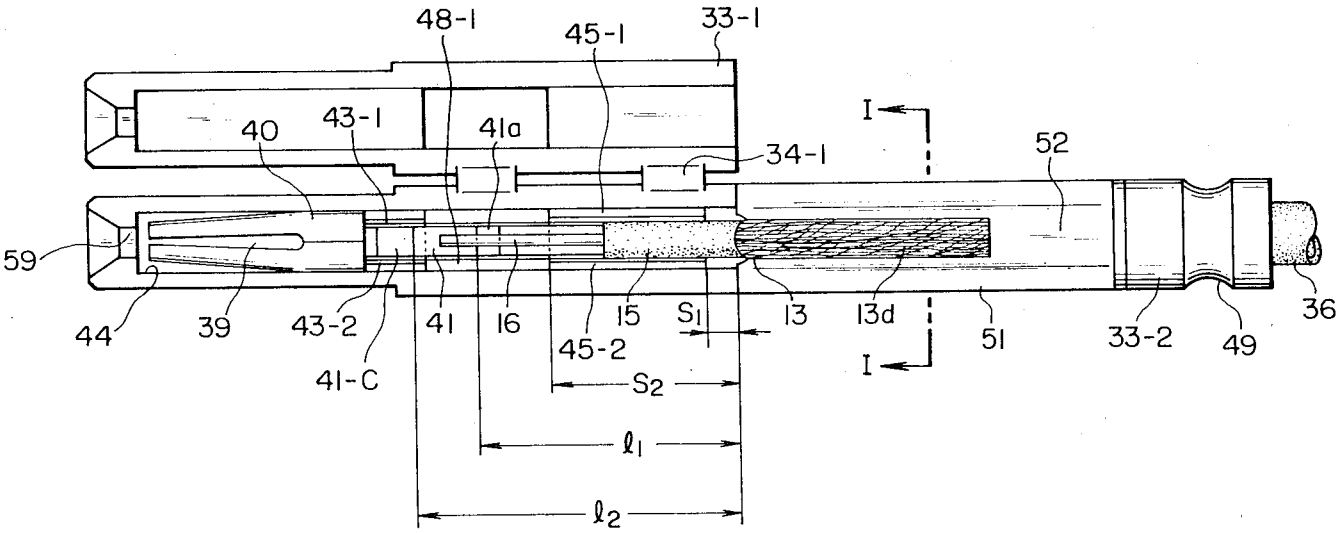
FIG. 10 is a plan view showing the state wherein the coaxial cable 36 and ferrule 51 are attached to the cylindrical holder 31 with a lid member 33-1 opened.

The rear end portion of the connection segment 41 is laid between clamp segments 45-1 and 45-2 which are spaced rearward from the positioning segments 43-1 and 43-2 and formed on the support member 32. The section between these positioning segments 43-1, 43-2 and clamp segments 45-1, 45-2 defines a core wire connection section 46. The rear portion of the clamp segments 45-1, 45-2 is treated as a cable holding section 47, in which one end portion of the coaxial cable 36 still having the sheath 12 is stored and held in place. As shown in FIG. 10, the exposed inner insulator 15 is positioned and placed between the clamp segments 45-1 and 45-2, and the exposed core wire 16 is placed on the connection segment 41 positioned in the core wire connection section 46.

With respect to the opening 35 left between the lid members 33-1 and 33-2 a ferrule 51 is disposed in such a way as is shown in FIG. 10. In FIG. 10, the lid member 33-2 is alone closed to cover the support member 32.

Figure 7A:
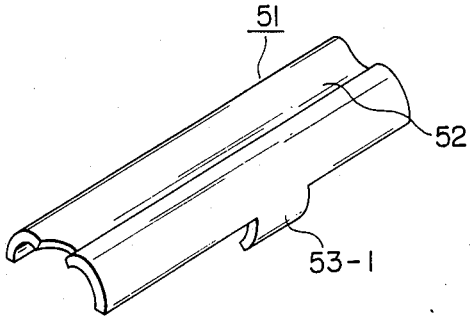
FIGS. 7A and 7B are perspective views showing examples of a ferrule.

The ferrule 51 is substantially semi-cylindrical as shown in FIG. 7A and formed by bending an elastic conductive plate made of montifiere metal, for example. On the top of the semi-cylindrical ferrule 51 a shallow concave portion 52 is formed over the whole length in parallel with the axial center, and from the center portion of either side margin of the ferrule 51 project integral elastic holding segments 53-1 and 53-2.

Figure 11:
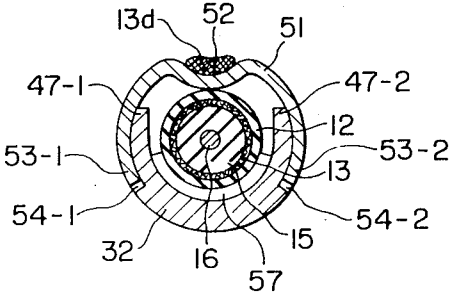
FIG. 11 is a cross sectional view taken along line I—I in FIG. 10.

In outer peripheral portions of the support member 32 on either side of the opening 35 coupling notches 54-1 and 54-2 are formed in which the elastic holding segments 53-1 and 53-2 are fitted. As shown in FIGS. 10 and 11, when the coaxial cable 36 is loaded into the cable holding section 47 of the support member 32, the ferrule 51 is attached to the support member 32. The ferrule 51 is temporarily secured to the support member 32 by bringing the elastic holding segments 53-1 and 53-2 of the ferrule 51 into elastic engagement with the coupling notches 54-1 and 54-2, respectively. Inside the side margins of the support member 32 on either side of the opening 35 guide segments 47-1 and 47-2 are also formed integrally.

On the concave portion 52 of the ferrule 51 the outer conductor connection segment 13*d* of the outer conductor 13 of the coaxial cable 36, which was previously twisted into a braid shape and led out sideways, is disposed and folded there, this outer conductor connection segment 13*d* then having connected electrically to the concave portion 52 by soldering, for example. The soldering operation can be achieved easily because of the foregoing temporary securing of the ferrule 51.

In the support member 32 and lid member 33-1 windows 48-1 and 48-2 are formed respectively at a position corresponding to the core wire connection section 46. Accordingly, connection of the core wire 16 of the coaxial cable 36 with the connection portion 41*a* of the connection segment 41 can be achieved, after the lid member 33-1 has been pivoted to cover the support member 32, through the windows 48-1 and 48-2 by spot welding, for example. Of course, this connection between the connection segment 41 and core wire 16 may be achieved by soldering or pressure welding.

Figure 12:
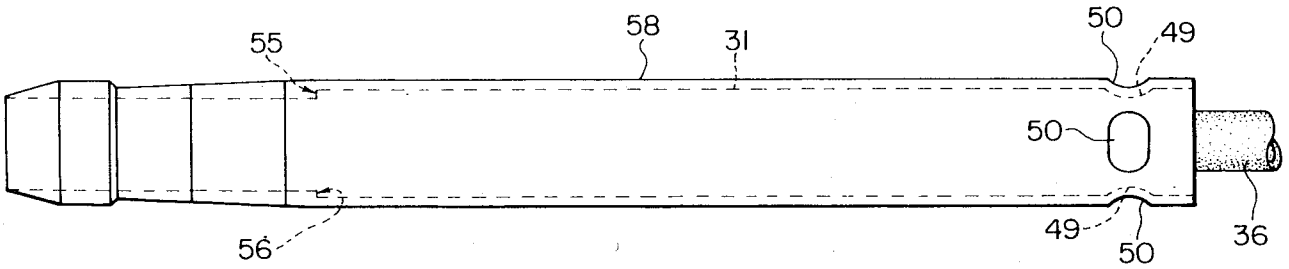
FIG. 12 is a plan view showing the above embodiment of the coaxial cable connector according to the present invention.

At this stage, the cylindrical holder 31 comprising the support member 32 and lid members 33-1 and 33-2 in the closed state is press-fitted into a cylindrical body 58 made of conductive material, such as brass, from the front end as shown in FIG. 12. The cylindrical body 58 is then pushed at several spots of its rear end portion into a ring-shaped concave portion 49 formed on the outer periphery of the cylindrical holder 31 so as to leave calked recesses 50, whereby the cylindrical body 58 and cylindrical holder 31 are secured together. As the cylindrical holder 31 is press-fitted into the cylindrical body 58, the ferrule 51 comes into elastic contact with the cylindrical body 58 and deforms elastically, whereby both are electrically connected satisfactorily.

The outer diameter of the front end portion of the cylindrical holder 31 is reduced to form a ring-shaped stepped portion or shoulder 55, and the inner diameter of front end portion of the cylindrical body 58 is also reduced to form a ring-shaped stepped portion or shoulder 56, so that when the cylindrical holder 31 is inserted into the cylindrical body 58 the shoulder 55 abuts on the shoulder 56, whereby holder 31 and body 58 are positioned correctly relative to one another.

As shown in FIGS. 4 and 8, on the inner surface of the cable holding section 47 of the support member 32 and on the inner surface of the lid member 33-2, elongate projections 57 extending circumferentially and having a triangle shape in cross section are formed at an appropriate interval, which bite into the sheath 12 of the coaxial cable 36 so as to make certain the holding of the coaxial cable 36. In the front end of the cylindrical holder 31 a small hole 59 is formed correspondingly to a center hole of the center contact 38, and guided by this small hole 59 a mating contact is inserted into the cylindrical holder 31, and then press-fitted into the center contact 38 so that it comes into contact therewith.

In the cylindrical holder 31 of the foregoing embodiment, the support member 32 and lid members 33-1 and 33-2 are coupled by the hinge portions 34-1 and 34-2 into a single body, so that because of the elasticity of synthetic resin the support member 32 and lid members 33-1 and 33-2 tend to maintain the open position. Accordingly, in this open state, the elastic 40 and connection segment 41 are put on the support member 32, the outer conductor connection segment 13*d* is led out sideways, and the core wire 16 and connection segment 41 are connected together. Then, the lid member 33-1 is closed, the thus assembled unit is inserted into the cylindrical body 58, the ferrule 51 is attached to the cylindrical holder 31, the outer conductor connection segment 13*d* is soldered to the ferrule 51, the cylindrical holder 31 is inserted further into the cylindrical body 58, the lid member 33-2 is closed, and the cylindrical holder 31 is further inserted into the cylindrical body 58. At the time of insertion of the ferrule, an appropriate tool may be used when necessary.

Figure 13:
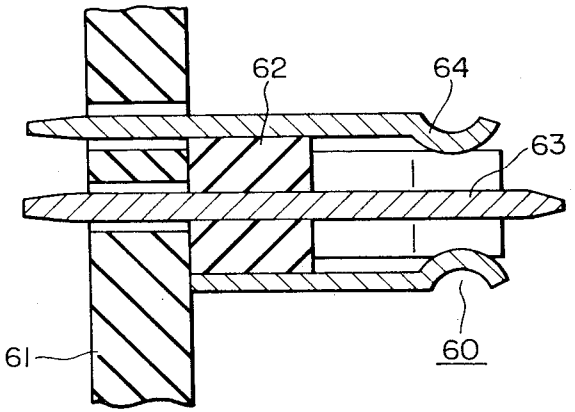
FIG. 13 is a cross sectional view showing a mating connector which will be coupled and connected to the above embodiment of the present connector.

The mating connector to be joined and connected with the connector according to the present invention may be structured as shown in FIG. 13, for example. A pin contact 63 is inserted in an insulation block 62 and secured in place, the insulation block 62 is fitted in one end of an outer conductor 64 and secured in place, and the thus assembled members are supported by a board 61 and wired thereto. The end of the outer conductor 64 remote from the board 61 is split into several parts. As the cylindrical body 58 shown in FIG. 12 is fitted into the outer conductor 64, the pin contact 63 is inserted into the cylindrical holder 31 and coupled to the center contact 38, so that the core wire 16 of the coaxial cable 36 is connected electrically to the pin contact 63.

Figure 7B:
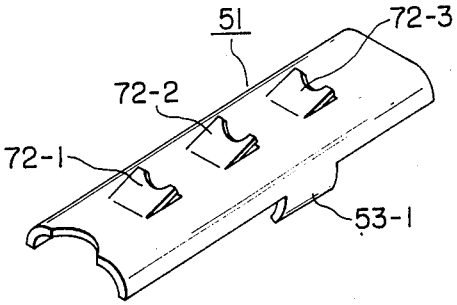

The ferrule 51 can be produced in the alternative configuration shown in FIG. 7B, by making substantially flat the top of a semi-cylindrical member and generating coupling segments 72-1 through 72-3 on the flat top, which may be formed by cutting top portions and erecting them in the same direction. In the case of using this alternative ferrule 51, the outer conductor connection segment 13*d*, previously twisted into a braid shape and led out sideways, is put on the coupling segments 72-1 through 72-3 of the ferrule 51 and under the above state the cylindrical holder 31 is inserted into the cylindrical body 58 so as not to cause the coupling segments 72-1 through 72-3 to be caught on the cylindrical body, whereby the outer conductor connection segment 13*d* comes into elastic contact with the cylindrical body 58 by means of the coupling segments 72-1 through 72-3.

The coaxial cable connector according to the present invention has fewer structural parts than the prior art connector, and can be produced at a high degree of quality with low manufacturing costs by pressing and molding. According to the present invention, connection of the center contact 38 with the core wire 16 can easily be achieved in the open state of the lid members after the coaxial cable 36 and center contact 38 are disposed on the support member 32, and connection between the ferrule 51 and the outer conductor 13 can be achieved easily too. Therefore, the assembling operation is simplified and the connector is miniaturizable.

Since the position in the axial direction of the coaxial cable 36 with respect to the support member 32 is determined by abutment of the folded point of the outer conductor connection segment 13*d* on the front side margin of the ferrule 51, the projecting length of the core wire 16 is sufficient if it falls between $l_1$, or the connection portion 41*a* of the connection segment 41 and $l_2$, or the bent portion of the same, as shown in FIG. 10. Similarly, the projecting length of the inner insulator 15 is sufficient if it falls between $S_1$, or the rear end of the clamp segments 45-1 and 45-2 and $S_2$, or the front end of the same. Accordingly, a relatively large tolerance is permitted in processing the coaxial cable, i.e. a rough processing of the coaxial cable is permitted. For reference, the position in the axial direction of the center contact 40 is determined properly and rightly by putting it on the cylindrical holder 31 and on the basis of the positioning means, which are the ring-shaped stepped portions 55 and 56, and becomes effective when the cylindrical holder 31 is inserted into the cylindrical body 58.

Although in the embodiment the elastic clamp member 40 is drawn out frontward by putting in and taking out the mating contact relatively, the bent portion 41-C of the connection segment 41 functions as a buffering portion, so that no mechanical force is applied to the connected point between the core wire 16 and the connection segment 41, and this connected point is kept stably. Further, as shown in FIGS. 4 and 9, by designing the positioning segments 43-1 and 43-2 and clamp segments 45-1 and 45-2 so as to project beyond the support member 32 and causing them to abut almost on the inner surface of the lid member 33-1, the lid member 33-1 is positioned properly when closed.

Figure 14:
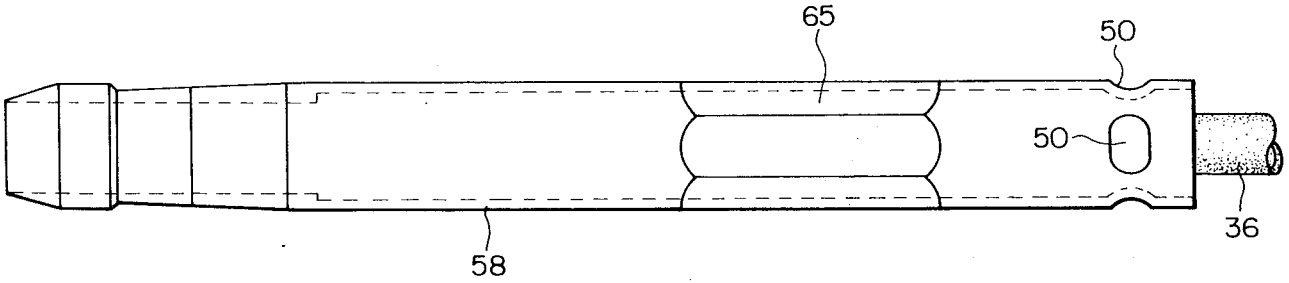
FIG. 14 is a plan view showing another embodiment of the coaxial cable connector according to the present invention.

In modification of the invention, the support member 32 may be made independent of the lid members 33-1, 33-2. A male contact may be used as the center contact 38. It is also possible to make relatively large the diameter of the cylindrical body 58, thereby to result in a loose insertion of the cylindrical holder 31 into the cylindrical body 58. In this case, as shown in FIG. 14, a portion of the cylindrical body 58 corresponding to the furrule 51 is calked into a hexagonal shape so that his calked portion 65 causes the ferrule 51 and cylindrical body 58 to come into elastic contact with one another.

What is claimed is:

1. A coaxial cable connector comprising a cylindrical holder made of an insulator material and composed of a support member and a lid member of semi-cylindrical configuration which correspond to parts formed by dividing said cylindrical holder into two parts along the axial center of said cylindrical holder, the interior of a front end portion of said cylindrical holder being shaped to define a contact holding section, the rear of said contact holding section being shaped to define a core wire connection section, the rear of said core wire connection section being shaped to define a cable holding section, and said cable holding section having an opening formed therein, a center contact held in said contact holding section of said cylindrical holder, said center contact engaging and being electrically connected to a contact to be connected which is inserted into said cylindrical holder from the front end of said holder, said center contact having an integral connection segment extending to said core wire connection section, a coaxial cable one end of which is stored and held inside said cylindrical holder at the rear of said contact holding section with the other end of said coaxial cable being led out of the rear end of said cylindrical holder, said one end of said coaxial cable having a core wire which is exposed and electrically connected to said connection segment in said core wire connection section, said one end of said coaxial cable also having an outer conductor portion which is folded down and located opposite to said opening, an elastic ferrule positioned in said opening and interposed between a sheath of said coaxial cable in said cable holding section and said folded outer conductor portion, and a metallic cylindrical body into which said cylindrical holder is inserted and held therein, said metallic cylindrical body being electrically connected to said outer conductor through elastic deformation of said ferrule.

2. A coaxial cable connector as set forth in claim 1 wherein said folded outer conductor portion has a fold point which is positioned adjacent the front end margin of said ferrule.

3. A coaxial cable connector as set forth in claim 1, wherein said support member and said lid member are coupled together by a hinge so that both said members can open and close relative to one another.

4. A coaxial cable connector as set forth in claim 3, wherein said support member and said lid member are coupled by a hinge portion forming said hinge that is a portion of one side margin; said support member, said lid member and said hinge portion being parts of a single molded body.

5. A coaxial cable connector as set forth in claim 3, wherein a positioning segment is formed integrally with said support member on either side of said connection segment, the position of said center contact being determined by abutment of said positioning segments against a rear end face of said center contact.

6. A coaxial cable connector as set forth in claim 3, wherein an elongate projection is formed integrally on the inner surface of said cable holding section to bite into a sheath of said coaxial cable.

7. A coaxial cable connector as set forth in claim 3, wherein said connection segment has a bent portion between the connection point of said connection segment with the core wire and said center contact, said bent portion having a U-shaped form extending in a direction orthogonal to the lengthwise direction of said connection segment.

8. A coaxial cable connector as set forth in claim 3, wherein said cylindrical body is calked at a portion corresponding to said ferrule to reduce its diameter, whereby said ferrule comes into elastic contact with said body at the calked portion.

9. A coaxial cable connector as set forth in claim 3, wherein said lid member is divided into a front part and a rear part, the space between said divided parts defining said opening.

10. A coaxial cable connector as set forth in claim 9, wherein said ferrule is substantially semi-cylindrical, the outer diameter of said ferrule substantially equal to that of said cylindrical holder at the position of said opening.

11. A coaxial cable connector as set forth in claim 10, wherein the top of said ferrule is formed with the axial center of said cylindrical holder, an outer conductor connection segment formed by twisting said folded outer conductor portion into a braid shape being disposed on said concave portion, and said outer conductor connection segment being coupled to said ferrule through welding or soldering, whereby said ferrule is in direct elastic contact with said outer conductor and electrically connected thereto.

12. A coaxial cable connector as set forth in claim 10, wherein the top of said ferrule is substantially flat, said flat top having a plurality of coupling segments thereon which are aligned in a direction along the axial center, on said coupling segments an outer conductor connection segment formed by twisting said folded outer conductor portion into a braid shape is disposed, and said outer conductor connection segment is elastically engaged with said cylindrical body by said coupling segments.

13. A coaxial cable connector as set forth in claim 10, wherein said ferrule has a pair of elastic holding segments formed integrally with the side margins of said ferrule respectively, a pair of coupling notches formed in said support member, said elastic holding segments being fitted into said coupling notches, said ferrule being coupled to and held on said support member by means of said elastic holding segments.

14. A coaxial cable connector as set forth in claim 10, wherein a pair of guide segments are formed integrally on said support member inside the side margins of said opening, said semi-cylindrical ferrule having side margins which are positioned outside said guide segments.

15. A coaxial cable connector as set forth in claim 3, wherein a pair of clamp segments are formed integrally between said core wire connection section and said cable holding section on said support member, the inner insulator at one end of said coaxial cable being positioned and disposed between said clamp segments.

16. A coaxial cable connector as set forth in claim 15, wherein said clamp segments project beyond said support member to locations closely adjacent said lid member to guide and position said lid member.

17. A coaxial cable connector as set forth in claim 3, wherein said support member is formed with a window at a position corresponding to said core wire connection section, thereby to permit welding of said core wire to said connection segment through said window.

18. A coaxial cable connector as set forth in claim 17, wherein said lid member is formed with a window opposite to said window of said support member.

19. A coaxial cable connector as set forth in claim 3, wherein there are provided positioning means which abut on each other when said cylindrical holder is inserted into said cylindrical body.

20. A coaxial cable connector as set forth in claim 19, wherein a ring-shaped concave portion is formed in the outer surface of said cylindrical holder, whereby as a portion of said cylindrical body is pushed into said ring-shaped concave portion said cylindrical body and said cylindrical holder are secured together.

* * * * *